United States Patent [19]

DeBolt et al.

[11] Patent Number: 5,045,890

[45] Date of Patent: Sep. 3, 1991

[54] FUSER APPARATUS WITH RELEASE AGENT DELIVERY SYSTEM

[75] Inventors: Frederick C. DeBolt, Penfield; Andrew C. LaRocca, Fairport; Kenneth R. Rasch, Webster, all of N.Y.

[73] Assignee: Xerox Corporation, Stamford, Conn.

[21] Appl. No.: 334,414

[22] Filed: Apr. 7, 1989

[51] Int. Cl.[5] ..... G03G 15/20; G03G 21/00

[52] U.S. Cl. ..... 355/284; 355/300

[58] Field of Search ..... 355/282, 284, 290, 295, 355/300; 219/216

[56] References Cited

U.S. PATENT DOCUMENTS

| | | | |
|---|---|---|---|
| 3,526,457 | 9/1970 | Dimond et al. | 355/300 |
| 3,672,764 | 6/1972 | Hartwig et al. | 355/300 |
| 3,740,864 | 6/1973 | Ito et al. | 345/300 |
| 3,941,558 | 3/1976 | Takiguchi | 432/60 |
| 4,056,706 | 11/1977 | Strella | 219/216 |
| 4,393,804 | 7/1983 | Nygard et al. | 355/284 X |
| 4,498,757 | 2/1985 | Lance et al. | 355/285 |
| 4,557,588 | 12/1985 | Tomosada | 355/300 |
| 4,716,435 | 12/1987 | Wilson | 355/290 |
| 4,939,552 | 7/1990 | Nakanishi | 355/300 |
| 4,945,381 | 7/1990 | Yamagata et al. | 355/27 |

*Primary Examiner*—Fred L. Braun

[57] ABSTRACT

Fuser apparatus for heat fusing toner images to a print substrate has a fuser roll and a pressure roll forming a fusing nip therebetween, a system to deliver liquid release agent to the fuser roll including a movable web having a first side and a second side supported between a web supply roll and a web take-up roll, a housing supporting the supply roll and take-up roll such that one of the supply and take-up rolls is on one side of the fuser roll and the other is on the other side of the fuser roll and the first side of the movable web is in contact with the fuser roll along a path parallel to its longitudinal axis. The movable web is impregnated with a liquid release agent and the movable web, supply roll and take-up roll are reversibly mounted in the housing to deliver liquid release agent to the fuser roll initally from the first side of the movable web followed by reversing the location of the supply roll and take-up roll in the support housing so that the second side of the impregnated web is in contact with the fuser roll to deliver release agent. The movable web is urged into delivery engagement with the fuser roll by an open celled foam pinch roll impregnated with liquid release agent.

11 Claims, 5 Drawing Sheets

FUSER APPARATUS WITH RELEASE AGENT DELIVERY SYSTEM

CROSS REFERENCE TO RELATED APPLICATIONS

Reference is made to the following copending applications filed concurrently herewith: application Ser. No. 07/334,416 now U.S. Pat. No. 4,929,983, entitled "STRIPPER MECHANISM" in the name of Barton et al. application Ser. No. 07/334,415, entitled "FUSER RELEASE AGENT MANAGEMENT CONTROL" in the name of DeBolt et al.; and application Ser. No. 07/334,413, now abandoned, entitled "STRIPPER MECHANISM FOR REMOVING COPY SUBSTRATES FROM A SOFT ROLL FUSER" in the name of Paul M. Fromm.

BACKGROUND OF THE INVENTION

The present invention relates to fuser apparatus for electrostatographic printing machines and in particular to a roll fuser release agent delivering apparatus.

In electrostatographic reproducing apparatus commonly used today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image contained within the original document. Alternatively, a light beam may be modulated and used to selectively discharge portions of the charged photoconductive surface to record the desired information thereon. Typically, such a system employs a laser beam. Subsequently, the electrostatic latent image on the photoconductive insulating surface is made visible by developing the image with developer powder referred to in the art as toner. Most development systems employ developer which comprises both charged carrier particles and charged toner particles which triboelectrically adhere to the carrier particles. During development, the toner particles are attracted from the carrier particles by the charged pattern of the image areas of the photoconductive insulating area to form a powder image on the photoconductive area. This toner image may be subsequently transferred to a support surface such as copy paper to which it may be permanently affixed by heating or by the application of pressure.

In order to fix or fuse the toner material onto a support member permanently by heat, it is necessary to elevate the temperature of the toner material to a point at which constituents of the toner material coalesce and become tacky. This action causes the toner to flow to some extent into the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the fuser roll thereby to affect heating of the toner images within the nip. Typical of such fusing devices are two roll systems wherein the fusing roll is coated with an abhesive material, such as a silicone rubber or other low surface energy elastomer or, for example, tetrafluoroethylene resin sold by E. I. DuPont de Nemours under the trademark Teflon. In these fusing systems, however, since the toner image is tackified by heat it frequently happens that a part of the image carried on the supporting substrate will be retained by the heated fuser roller and not penetrate into the substrate surface. This tackified toner may stick to the surface of the fuser roll, offset to a subsequent sheet of support substrate, offset to the pressure roll when there is no sheet passing through a fuser nip resulting in contamination of the fuser roll, pressure roll and marked copies.

It has also been proposed to provide toner release agents such as silicone oil, in particular, polydimethyl silicone oil, which is applied on the fuser roll to a thickness of the order of about 1 micron to act as a toner release material. These materials possess a relatively low surface energy and have been found to be materials that are suitable for use in the heated fuser roll environment. In practice, a thin layer of silicone oil is applied to the surface of the heated roll to form an interface between the roll surface and the toner image carried on the support material. Thus, a low surface energy, easily parted layer is presented to the toners that pass through the fuser nip and thereby prevents toner from offsetting to the fuser roll surface.

Various systems have been used to deliver release agent fluid to the fuser roll including the use of oil soaked rolls and wicks with and without supply sumps as well as oil impregnated webs. The oil soaked rolls and wicks generally suffer from the difficulty in that they require a sump of oil to replenish the roll and the wick as its supply of release agent is depleted by transfer to the fuser roll. Furthermore, they suffer from the difficulty in that they have a relatively short life of the order of around 10,000 prints. Furthermore, these systems suffer from the further difficulty in that their surfaces in contact with the fuser roll are constant whereby contamination particularly by toner can readily occur further reducing valuable life. The web systems do not suffer from the above-noted difficulties and additionally have the advantage of providing an evergreen cleaning surface.

PRIOR ART

U.S. Pat. No. 3,941,558 to Takiguchi describes a fuser apparatus wherein an elongated web-like cleaning member is impregnated with an offset preventing material such as a silicone oil and is supported between a supply roll and a take-up roll which is in contact with the heated fuser roll to simultaneously clean the fuser roll and apply release agent thereto.

In addition, there are several automatic printing machines commercially available. For example, the Canon 3225, 3725, 3000 series, 4000 series and 5000 series products all have liquid release agent impregnated web supported between a supply roll and a take-up roll and urged into contact with the fuser roll by an open celled foam pinch roll.

SUMMARY OF THE INVENTION

In accordance with a principle aspect of the present invention, a fuser apparatus for heat fusing toner images to a print substrate comprises a fuser roll and pressure roll forming a fusing nip therebetween and means to deliver liquid release agent to the fuser roll which includes a movable web having a first side and a second side supported between a web supply roll and web take-up roll, a housing supporting said supply and take-up rolls such that one of the supply roll and the take-up roll was on one side of the fuser roll and the other is on the other side of the fuser roll and the first side of the movable web is in contact with the fuser roll along a path parallel to its longitudinal axis, the movable web being impregnated with a liquid release agent and the movable web supply roll and take-up roll being reversibly mounted in the housing to deliver liquid release agent to the fuser roll initially from the first side of the movable web and further including means to enable reversing the location of the supply roll and take-up roll in the support housing so that the second side of the impregnated web is in contact with the fuser roll to deliver release agent to the fuser roll and the movable web is urged into delivery engagement with the fuser by an open celled foam pinch roll impregnated with liquid release agent.

In accordance with a further aspect of the present invention the open celled foam pinch roll is spring biased toward the fuser roll with a load of about 1.5 pounds.

In a further aspect of the present invention the apparatus includes means to advance the release agent impregnated web from the supply roll to the take-up roll at a substantially constant rate to deliver release agent to the fuser roll at a substantially constant rate and further includes means to advance said web at a rate different from the substantially constant rate to deliver release agent to the fuser roll at rate different from said substantially constant rate.

In a further aspect of the present invention the web is advanced at substantially constant rate for a printing run of up to a predetermined number of prints and it is advanced at a rate greater than said constant rate for printing run greater than said predetermined number.

In accordance with a further aspect of the present invention, the means to enable reversing the location of the supply roll and take-up roll so that the second side of the impregnated web is in contact with the fuser roll includes two interchangeable rotatable tubular support cores one for each of the supply roll and the take-up roll.

In a further aspect of the present invention the supply roll core has a supply of release agent impregnated web material wound around the core and the housing includes means to tension the core to resist unwinding.

In a further aspect of the present invention, the take-up roll is mounted on a drive shaft to advance the web from the supply roll to the take-up roll and the housing includes means to prevent the take-up shaft from unwinding.

In accordance with a further aspect of the present invention, the open celled foam pinch roll is a silicone rubber having a durometer of about 25 Shore A and a cell size less than about 0.5 millimeters.

In a further aspect of the present invention, the liquid release agent is a silicone oil having the viscosity of about 11,000 centistokes.

In a further aspect of the present invention, the web is a non-woven fibrous material capable of holding at least twenty-five grams of liquid release agent per square meter.

In a further aspect of the present invention, the silicone oil is delivered to the fuser roll at the rate of about 0.3 microliters per copy.

Other features of the present invention will become apparent as the following description proceeds and upon reference to the drawings.

DESCRIPTION OF THE PREFERRED EMBODIMENT

The invention will now be described with reference to a preferred embodiment of the fuser apparatus in an electrostatographic printing machine.

Figure 1:
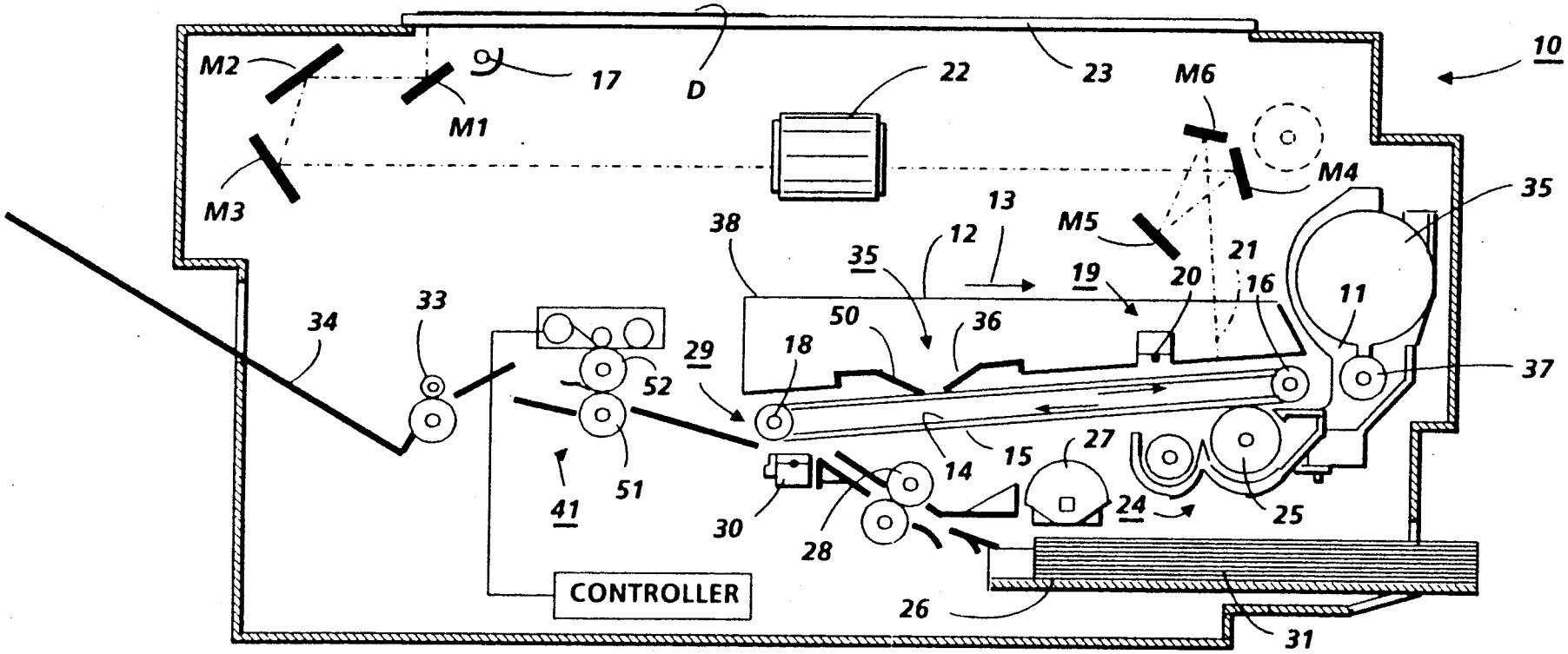
FIG. 1 is a schematic representation in cross-section of an automatic electrostatographic printing machine with the fuser apparatus according to the present invention.

Referring now to FIG. 1, there is shown by way of example, an automatic electrostatographic reproducing machine 10 which includes a fuser apparatus according to the present invention. The reproducing machine depicted in FIG. 1 illustrates the various components utilized therein for producing copies from an original document. Although the apparatus of the present invention is particularly well adapted for use in automatic electrostatographic reproducing machines, it should become evident from the following description that it is equally well suited for use in a wide variety of processing systems including other electrostatographic systems and is not necessarily limited in application to the particular embodiment or embodiment shown herein.

The reproducing machine 10 illustrated in FIG. 1 employs a removable processing cartridge 12 which may be inserted and withdrawn from the main machine frame in the direction of arrow 13. Cartridge 12 includes an image recording belt like member 14 the outer periphery of which is coated with a suitable photoconductive material 15. The belt is suitably mounted for revolution within the cartridge about driven transport roll 16, around idler roll 18 and travels in the direction indicated by the arrows on the inner run of the belt to bring the image bearing surface thereon past the plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image.

The optical arrangement creating the latent image comprises a scanning optical system with lamp 17 and mirrors $M_1$, $M_2$, $M_3$ mounted to a a scanning carriage (not shown) to scan the original document D on the imaging platen 23, lens 22 and mirrors $M_4$, $M_5$, $M_6$ to transmit the image to the photoconductive belt in known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein developer is applied to the photoconductive surface 15 of the belt 14 rendering the latent image visible. The development station includes a magnetic brush development system including developer roll 25 utilizing a magnetizable developer mix having course magnetic carrier granules and toner colorant particles as will be discussed in greater detail hereinafter.

Sheets 31 of the final support material are supported in a stack arranged on elevated stack support tray 26. With the stack at its elevated position, the sheet separator segmented feed roll 27 feeds individual sheets therefrom to the registration pinch roll pair 28. The sheet is then forwarded to the transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt by the beam strength of the support material 31 as it passes around the idler roll 18, and the sheet containing the toner image thereon is advanced to fixing station 41 wherein roll fuser 52 fixes the transferred powder image thereto. After fusing the toner image to the copy sheet the sheet 31 is advanced by output rolls 33 to sheet stacking tray 34.

Although a preponderance of toner powder is transferred to the final support material 31, invariable some residual toner remains on the photoconductive surface 15 after the transfer of the toner powder image to the final support material. The residual toner particles remaining on the photoconductive surface after the transfer operation are removed from the belt 14 by the cleaning station 35 which comprises a cleaning blade 36 in scrapping contact with the outer periphery of the belt 14 and contained within cleaning housing 48 which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present application to illustrate the general operation of an automatic xerographic copier 10 which can embody the apparatus in accordance with the present invention.

Figure 2:
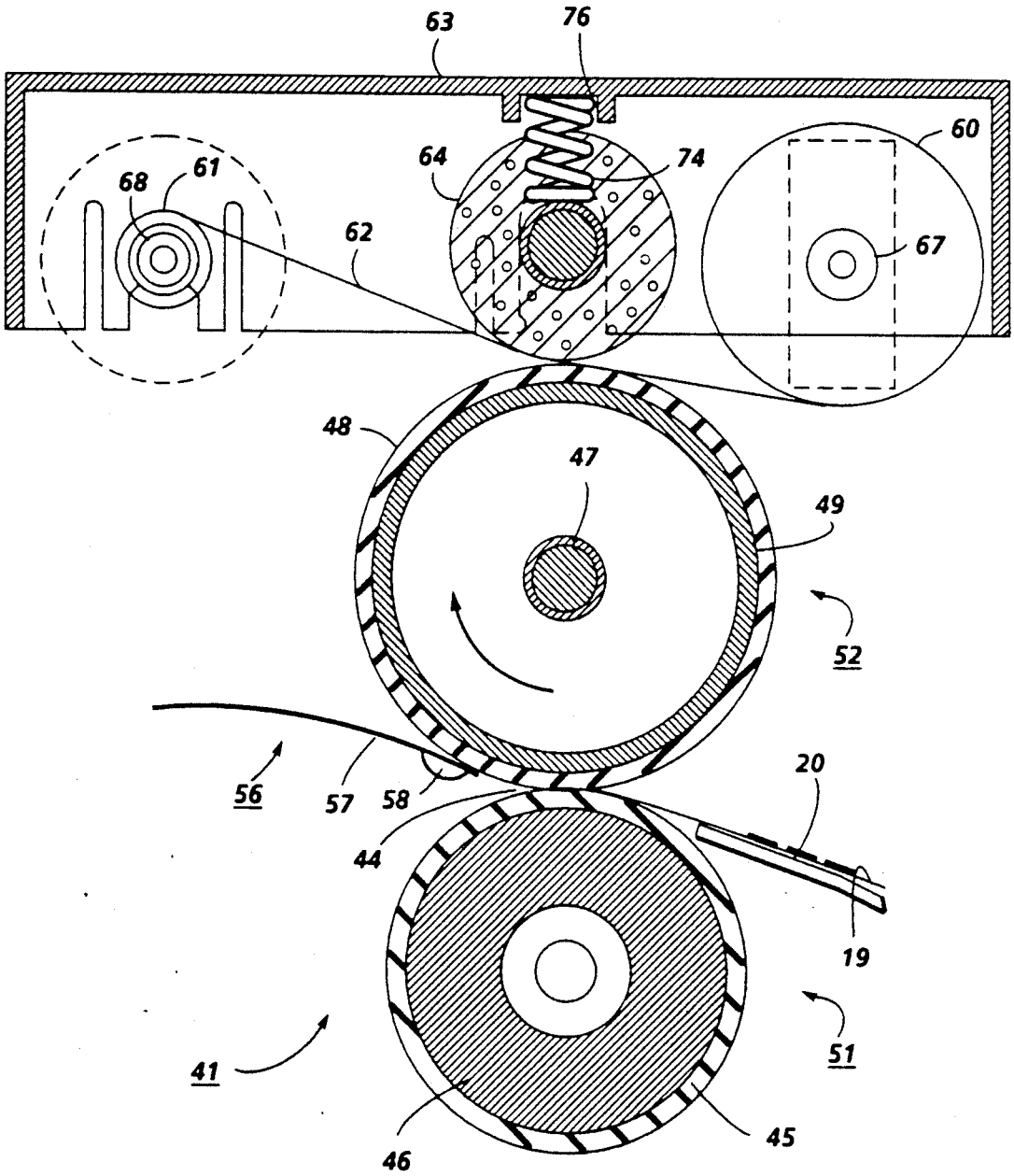
FIG. 2 is an enlarged view in cross-section of the fuser apparatus according to the present invention.
Figure 3:
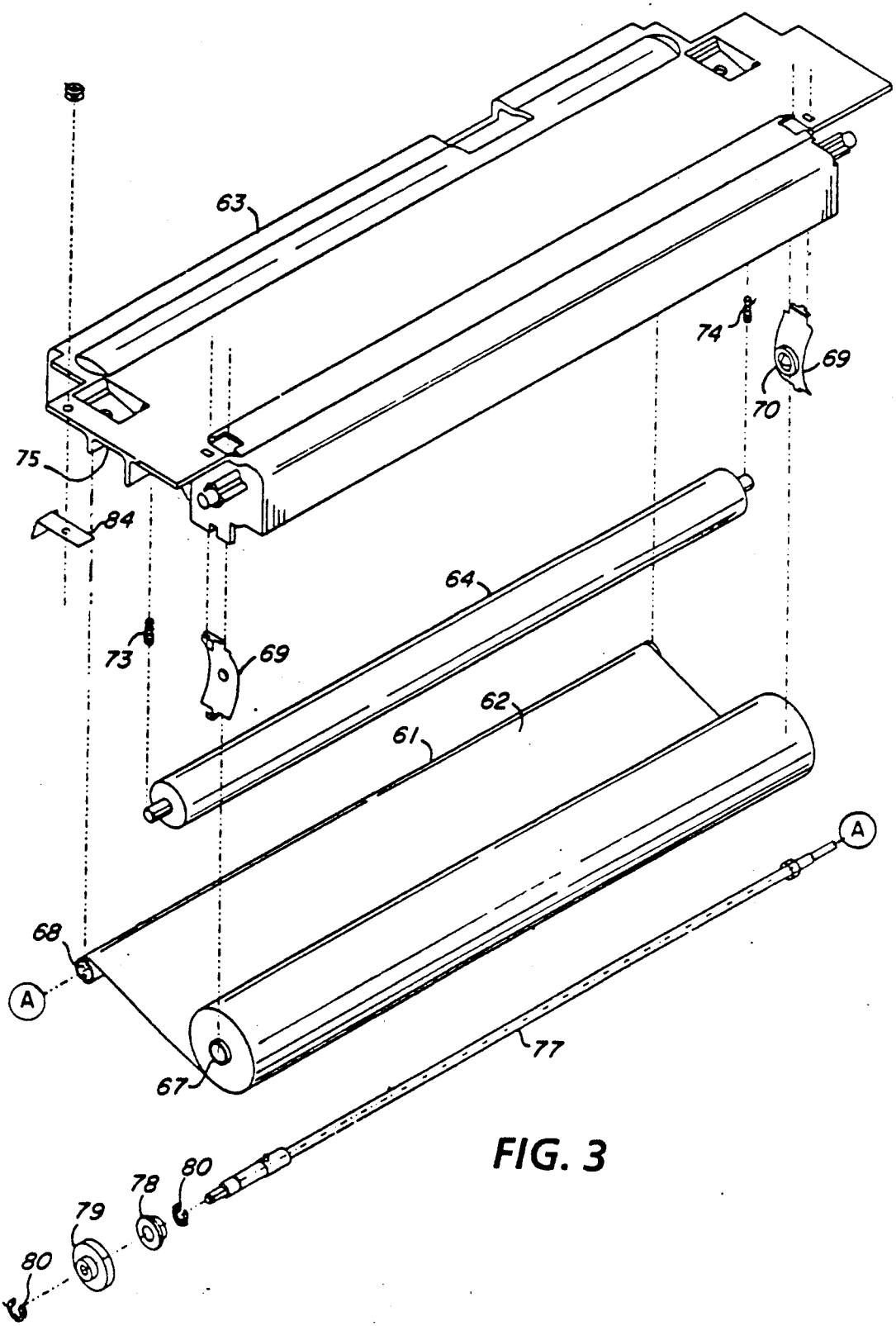
FIG. 3 is an exploded isometric view of the fusing apparatus according to the present invention.
Figure 4A:
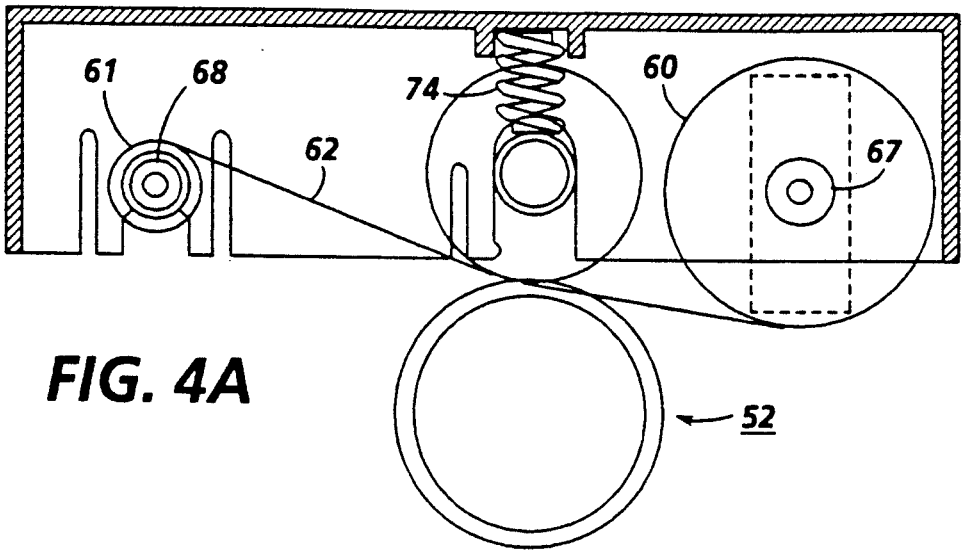
FIGS. 4A, 4B and 4C illustrate respectively an initial full web supply roll, an exhausted web supply roll and the reversal of the exhausted supply roll and full take-up roll to present the second side of the web to the fuser roll.
Figure 4B:
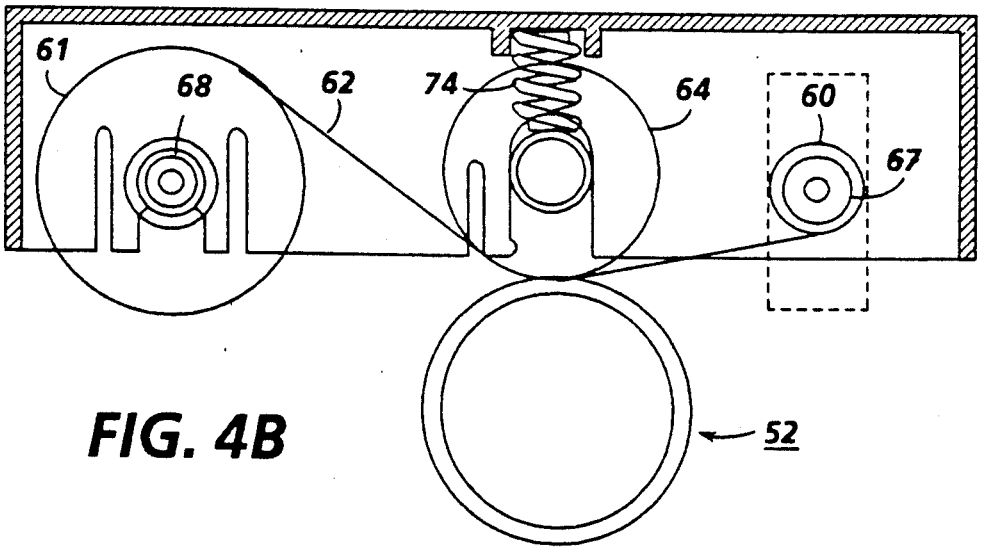
Figure 4C:
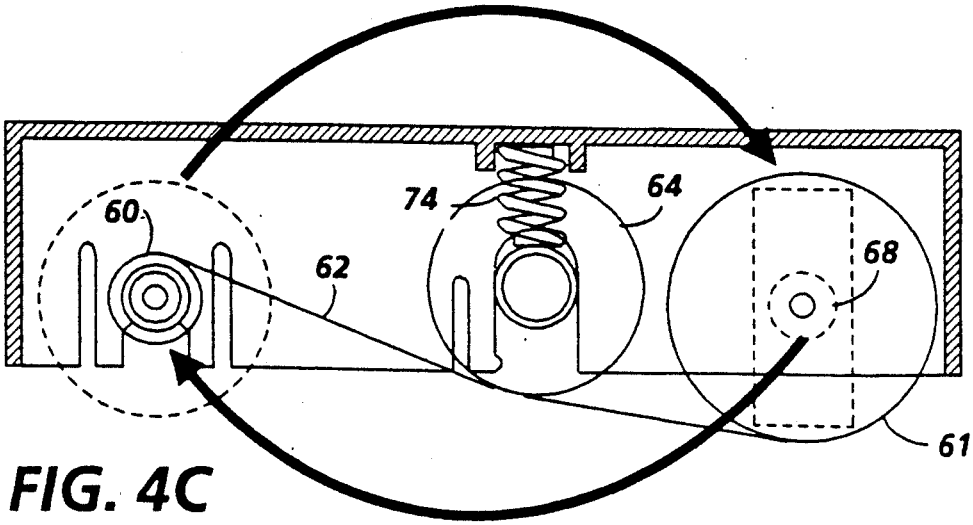
Figure 5:
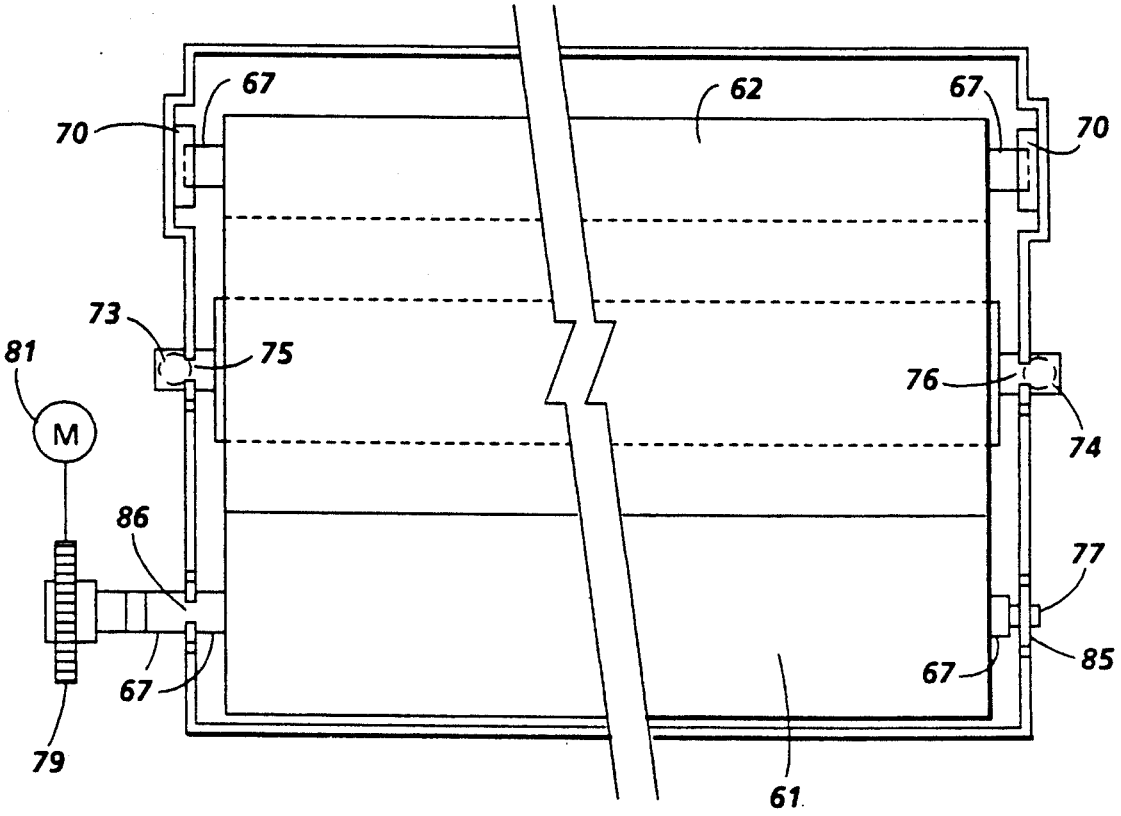
FIG. 5 is a plan view showing the mounting of the supply roll, take up roll and foam pinch roll.

Attention is now directed to FIGS. 2 and 3 wherein the fuser apparatus is described in greater detail. As shown in FIG. 2, the fuser roll 52 is composed of a core 49 having coated thereon a thin layer 48 of an elastomer. The core 49 may be made of various metals such as iron, aluminum, nickel, stainless steel, etc., and various synthetic resins. Aluminum is preferred as the material for the core 49, although this is not critical. The core 49 is hollow and a heating element 47 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention, and the fuser member can be heated by internal means, external means or a combination of both. All heating means are well known in the art for providing sufficient heat to fuse the toner to the support. The thin fusing elastomer layer may be made of any of the well known materials such as the RTV and HTV silicone elastomers.

The fuser roll 52 is shown in a pressure contact arrangement with a backup or pressure roll 51. The presure roll 51 comprises a metal core 46 with a layer 45 of a heat-resistant material. In this assembly, the pressure roll 51 is mounted on a shaft (not shown) which is biased so that the fuser roll 52 and pressure roll 51 are pressed against each other under sufficient pressure to form a nip 44. It is in this nip that the fusing or fixing action takes place. The layer 45 may be made of any of the well known materials such as fluorinated ethylene propylene copolymer, silicone rubber, or combinations thereof.

The liquid release agent delivery system or release agent management system comprises a housing 63 which may typically be a one-piece plastic molded member having mounting elements such as slots or holes for each of the web supply roll 60, the web take-up roll 61 and the open celled foam pinch roll 64. The web supply roll 60 and web take-up roll 61 are supported in the housing such that when a liquid release agent delivery system is in place, one of the supply roll 60 and take-up rolls 61 is on one side of the fuser roll 52 and the other is on the other side of the fuser roll and the movable web 62 is in contact with the fuser roll 52 along a path parallel to its longitudinal axis. In addition, the movable web 62 is urged into delivery engagement with the fuser roll by the open celled foam pinch roll 64 positioned on the side of the web 62 opposite the fuser roll 52. The supply roll 60 and take-up roll 61 are each made from interchangeable rotatable tubular support cores 67 and 68 to enable the reversibility of the web. The supply roll core 67 has a supply of release agent impregnated web material 62 wound around the core and is tensioned within the housing to resist unwinding by means of a leaf spring 69 at each end of the housing 63 which urges the mounting collars 70 into engagement with the rotatable tubular support core 67. The foam pinch roll 64 which is also impregnated with liquid release agent is spring biased toward the fuser roll by two coil spring 73 and 74, one at each of the pinch roll mounting slots 75 and 76 to apply pressure between the web 62 and the fuser roll 52 to insure delivery of an adequate quantity of release agent to the fuser roll. The pinch roll 64 is impregnated with release agent which insures that any sections of the web material which may have been loaded with inadequate quantities of release agent are supplied with release agent. The take-up roll 61 is mounted on a drive shaft 77 to advance the impregnated web from the supply roll 60 to the take-up roll 61.

The driven end of the drive shaft includes a bearing 78, gear 79 and two retaining rings 80 and is driven by a dedicated motor 81 such as an AC synchronous gear motor or clock motor. The housing has a anti-rotation clip 84 which engages the drive gear 79 on the drive shaft 77 to prevent the take-up roll shaft 77 from unwinding. The supply roll is mounted in two mounting collars 70 one on each end of the housing which are on leaf spring 69. The take-up roll has one end of the drive shaft mounted in a hole 85 in the housing and the other drive gear end mounted in a snap fitted slot 86 in the housing. Similarly, the pinch roll shaft is mounted in two slots 75 and 76.

Any suitable web material capable of withstanding fusing temperatures of the order of 225° C. may be employed. Typically, the web material is capable of being impregnated with at least 25 grams per meter square of liquid release agent. The web material may be woven or non-woven and of a sufficient thickness to provide a minimum amount of release agent for a desired life. For example, for a web material capable of holding about 30 grams of release agent per square meter, a thickness of 0.07 millimeters will provide a quantity of release agent capable of fusing about 100,000 prints. A particularly preferred web material is a non-woven aramid material with a polyester fiber-binder such as that available from E. I. duPont de Nemours & Company under the trademark Nomex. It should be understood that the principle function of the web is the delivery of the release agent and that a cleaning function wherein the fuser roll is cleaned is secondary. The web is advanced by a clock motor driving the drive shaft through a series of reducing duty cycles to maintain a constant rate of feed of web material through the nip between the fuser roll and the foam pinch roll. Typically, this rate is of the order of 2 millimeters per minute of copying wherein the web is advanced for a period of time beginning just before and ending just after the print enters and leaves the fuser nip. This rate web advancement of 2 millimeters per minute has been found to be satisfactory for print runs of the order of up to twenty prints per run. It has been found, however, that with longer runs beyond about twenty copies more release agent is required. This is due to the depletion characteristics of the fuser roll rubber. Thus, while the web may be advanced at a substantially constant rate to deliver release agent to the fuser roll at a substantially constant rate for printing runs up to about twenty prints, the controller on the printing machine may be programmed to advance the web at a greater rate when the printing run is greater than the predetermined number of prints. For example, while the web may be advanced at the rate of 2 millimeters per minute for printing runs up to twenty prints, it has been found that an increase of about 50% to 3 millimeters per minute is desirable to maintain adequate release of toner and substrate from the fuser roll. The preferred non-woven aramid web with a polyester fiber binder about 0.07 millimeters thick and capable of being impregnated with at least 25 grams of release agent per square meter and 13,500 millimeters long is capable of supplying release agent for between 80,000 and 110,000 copies.

The open celled foam pinch roll may be made of any suitable material which is resistant to high temperatures of the order of the fusing temperature at 225° C. and does not take a set. Typically, it is a molded silicone rubber foam with open cells to enable the storage of release agent which are not more than about 0.5 millimeters in their maximum dimension. Preferably, it is soft having a durometer of about 25 Shore A, is 4 to 5 millimeters longer than the web is wide and is loaded to the fuser roll with a force of about 1.5 pounds. If the force is less than about 1.5 pounds the web does not wrap correctly on the take-up roll resulting in premature failure.

The liquid release agent may be selected from those materials which have been conventionally used. Typical release agents include a variety of conventional used silicone oils including both functional and non-functionally oils. Thus, the release agent is selected to be compatible with the rest of the system. A particularly preferred release agent is an unimodal low molecular weight polysiloxane having a viscosity of about 11,000 centistokes. Such a release agent when used in a release agent delivery system as described above wherein about a 0.07 millimeter thick web is impregnated with at least 25 grams per square meter of release agent and a 20 millimeter diameter open celled, silicone rubber foam roll is also impregnated with the release agent, is consumed at a rate of about 0.3 microliters per copy.

In operation, as described above, the web is advanced only during that portion of the time just prior to the print entering and just after the print leaving the fuser to deliver release agent to the fuser roll. The controller is programmed to deliver release agent to the fuser roll at a substantially constant rate up to a predetermined number of prints in a print run. When the number of prints is entered into the control panel on the printing apparatus, if the number of prints desired in a particular print run is greater than the predetermined number, the controller is programmed to increase the speed of the clock motor to increase the advancement rate of the web and thereby the quantity of release agent delivered to the fuser roll. In addition, during a standby period after a printing run greater than a certain length the controller may be programmed to index the fuser roll a number of times at a stated interval to extract more release agent from the web and distribute it to the fuser roll and pressure roll to maintain release. A typical routine is to index the fuser roll after a printing run greater than 10 prints 270% three times at one minute intervals. Further the controller monitors the depletion of the web, for example, by keeping track of the time the motor is running and advises the machine operator on an appropriate code on the display panel when the supply of impregnated web material on the supply roll is becoming exhausted. For example, the printing machine operator or customer could be alerted initially when there is sufficient supply of web material for only say 2,000 prints and again when there is sufficient supply for 1,000 prints remaining on the supply roll at which time appropriate steps could be taken to insure continuity of operation. As discussed previously, the movable web supply roll and take-up roll are reversibly mounted in the housing to deliver liquid release agent and when the supply of web material has or is about to become exhausted the position of the supply roll and take-up roll may be reversed so that the second side of the impregnated web is in contact with the fuser roll to deliver release agent thereto. This is facilitated by having interchangeable rotatable tubular support cores for each of the supply roll and the take-up roll which may be manually removed from the mounting, flipped over and reinserted in their reversed positions. When the supply of impregnated web on the new supply roll (the take-up roll on the first side of the impregnated web) is or is about to be exhausted the supply roll web and take-up roll are removed and replaced with a new supply roll impregnated web and take-up roll which may be used in the same manner wherein initially a first side of the impregnated web is in contact with the fuser roll, its supply exhausted, the web is reversed and the second side of the impregnated web is placed in contact with the fuser roll to deliver release agent to it. During this process, it should be noted that the level of release agent in the open celled foam pinch roll is generally in equilibrium in that while the impregnated web delivers release agent to the fuser roll on one side the other side is in contact with the foam roll and resupplies release agent to it.

Thus, according to the present invention, the fuser apparatus with a liquid release agent delivery system having a long life which is compact and inexpensive has been provided. The long life was enabled by the design wherein an impregnated web supply roll and take-up roll may be reversed in position to enable delivery of release agent by the web to the fuser roll by both sides the web. In addition, by advancing the web continuously an evergreen cleaning surface is provided to the fuser roll so that no separate cleaner which may become contaminated is required. The present invention further provides a constant rate of release agent supplied to the fuser roll which may be adjusted for printing runs longer than a predetermined number of prints. Further, a liquid release agent delivery system is provided without the use of release agent bottles, sumps and the spillage contaminated associated therewith.

The disclosure of a patent referred to herein is hereby specifically and totally incorporated herein by reference.

While the invention has been described with references to specific embodiments, it will be apparent to those skilled in the art that many alternatives, modifications, and variations may be made. Accordingly, it is intended to embrace all such alternatives, modifications as may fall within the spirit and scope of the appended claims.

We claim:

1. Fuser apparatus for heat fusing toner images to a print substrate comprising a fuser roll and a pressure roll forming a fusing nip therebetween, means to deliver liquid release agent to said fuser roll comprising a movable web having a first side and a second side supported between a web supply roll and a web take-up roll, a housing supporting said supply roll and take-up roll such that one of said supply and take-up rolls is on one side of the fuser roll and the other is on the other side of the fuser roll and the first side of the movable web is in contact with the fuser roll along a path parallel to its longitudinal axis, said movable web being impregnated with a liquid release agent, said movable web, supply roll and take-up roll being reversibly mounted in said housing to deliver liquid release agent to said fuser roll initially from said first side of said movable web, means to enable reversing the location of said supply roll and take-up roll in said support housing so that the second side of said impregnated web is in contact with said fuser roll to deliver release agent thereto, said movable web being urged into delivery engagement with said fuser roll by an open celled foam pinch roll impregnated with liquid release agent.

2. The fuser apparatus of claim 1 wherein said foam pinch roll is spring biased toward said fuser roll with a load of about 1.5 pounds.

3. The fuser apparatus of claim 1 including means to advance said release agent impregnated web from said supply roll to said take-up roll at a substantially constant rate to deliver release agent to said fuser roll at a substantially constant rate and including means to advance said web at a rate different from said substantially constant rate to deliver release agent to said fuser roll at a rate different from said substantially constant rate.

4. The fuser apparatus of claim 3 wherein said web is advanced at said substantially constant rate for a printing run up to a predetermined number of prints and is advanced at a rate greater than said constant rate for a printing run greater than said predetermined number of prints.

5. The fuser apparatus of claim 1 wherein said means to enable comprises two interchangeable rotatable, tubular support cores, one for each of the supply roll and take-up roll.

6. The fuser roll of claim 5 wherein the supply roll core has a supply of release agent impregnated web material wound around said core and said housing includes means to tension said core to resist unwinding.

7. The fuser apparatus of claim 5 wherein the take-up roll core is mounted on a drive shaft to advance said web from said supply roll to said take-up roll and said housing includes means to prevent the take-up shaft from unwinding.

8. The fuser apparatus of claim 1 wherein said open cell foam pinch roll is a silicone rubber having a durometer of about 25 Shore A and a cell size less than about 0.5 mm.

9. The fuser apparatus of claim 1 wherein said liquid release agent is a silicone oil having a viscosity of about 11,000 centistokes.

10. The fuser apparatus of claim 9 wherein the silicone oil is delivered to said fuser roll at a rate of about 0.3 microliters per copy.

11. The fuser apparatus of claim 1 wherein said web is a non-woven fibrous material capable of holding at least 25 grams per square meter of liquid release agent.

* * * * *